United States Patent [19]

Bialy

[11] Patent Number: 4,895,273

[45] Date of Patent: Jan. 23, 1990

[54] SEMI AUTOMATIC DEVICE FOR APPLYING TEAR GAS

[75] Inventor: Jacob Bialy, Tel Aviv, Israel

[73] Assignee: ISPRA-Israel Product Research Co., Ltd., Herzlia, Israel

[21] Appl. No.: 243,065

[22] Filed: Sep. 9, 1988

[30] Foreign Application Priority Data

Sep. 15, 1987 [IL] Israel ..... 83907
May 23, 1988 [IL] Israel ..... 86468

[51] Int. Cl.[4] ..... B65D 83/00; A62C 13/38

[52] U.S. Cl. ..... 222/3; 222/402.11; 169/75

[58] Field of Search ..... 222/3, 53, 635, 402.11, 222/402.15, 501; 169/75, 76, 89

[56] References Cited

U.S. PATENT DOCUMENTS

| | | | |
|---|---|---|---|
| 1,606,191 | 11/1926 | Siebenmann | 222/3 |
| 2,530,583 | 11/1950 | Nurkiewicz | 222/153 |
| 2,541,073 | 2/1951 | Kaufman | 169/75 |
| 2,778,435 | 1/1957 | Downham et al. | 169/75 |
| 3,730,390 | 5/1973 | Adrian et al. | 222/79 |
| 4,058,921 | 11/1977 | Mason | 222/79 |
| 4,135,645 | 1/1979 | Kimmell | 222/78 |
| 4,446,990 | 5/1984 | Stevenson et al. | 222/82 |

*Primary Examiner*—Kevin P. Shaver
*Assistant Examiner*—Steven M. Reiss
*Attorney, Agent, or Firm*—Charles E. Baxley

[57] ABSTRACT

A semi automatic device for applying tear gas which includes a tear gas pressure vessel containing a compressed solution of tear gas agent disposed in a suitable solvent. The solution is forced out of the pressure vessel into the surroundings by gas vapor pressure through a valve having a small orifice. The valve is controlled by an axial lever mounted co-axially to a helical spring which resists the lever's movement. The lever engages a hammer which is mounted onto a triggerlike handle so that when the user presses the trigger the hammer engages the axial lever and moves it to release a tear gas spray through the valve orifice. When the trigger is released the co-axial helical spring returns the axial lever immediately to its home station thus disengaging it from said hammer and to close the valve orifice to prevent further flow of tear gas particles outward. There are also provided mechanisms for assuring that only a predetermined amount of tear gas is discharged.

8 Claims, 6 Drawing Sheets

SEMI AUTOMATIC DEVICE FOR APPLYING TEAR GAS

BACKGROUND OF THE INVENTION

Tear gas applying devices are known in the prior art, they are either non-automatic devices whereby the user operates a valve releasing the required amount of gas from a pressurized cylinder where the gas causing tears is stored. Or, such devices are in the form of a fully automatic valve controlled device usually triggered from a distance to release the tear gas contents from a pressurized cylinder for a predetermined time or until the full contents of the gas are released. Automatic valve control of this type could be accomplished either electrically or pneumatically.

The design contemplated herein of the semi automatic tear gas applying device precludes said device from being operated by mistake as a consequence of pressure being applied to the handle or trigger either by the user or by other means. The design also assures an automatic shut off of the tear gas valve immediately after application of a predetermined amount of such gas to minimize the amount of gas released, hence saving unnecessary gas use, and insuring that the amount of gas emitted is within normal medical limits.

Accordingly it is an object of this invention to provide a mechanical arrangement enabling the user of the tear-gas applying device to release a preset quantity of gas on each action of the trigger to achieve a result similar to a semi automatic weapon releasing one bullet at a time without the need of reloading.

It is another object of this invention to permit the user to release a quantity of gas adjusted to the regular needs he may have, as may be determined by the size of a room or size of a crowd he is confronted with, and without having to assess each time the quantity of gas to be released, as is the case in a manual operation, to thereby avoid an overcharge of gas. It will be understood that this enables the user to act faster by releasing the ideal quantity of gas to achieve the desired results without overdosing or underdosing.

Another important object of this invention is that the device is automatically set to the user's requirements when a need to use tear-gas arises. The equipment is portable and does not require a separate energy source.

SUMMARY OF THE INVENTION

The invention described herein provides a semi automatic tear-gas applying device comprising a tear gas pressure vessel containing a compressed solution of a chemical producing tears disposed in a suitable solvent. Said compressed solution is forced out of the pressure vessel into the surrounding area by the gas pressure in the vessel and flows through a valve having a small orifice. The value is controlled by a pin valve. The pin valve, as will be understood by one skilled in the art, engages a hammer means which is mounted on the trigger handle so that when the user presses the trigger the hammer engages the axial pin valve and moves it.

The pin valve is operated by a plate type trigger means which may be mounted coaxially to a helical spring mounted on one of the two handles of the device and a torque spring mounted on the same handle to operate said triggering plate when pressure is applied on it. The safety hammer is between the two handles of the device and is pressed down against said torque spring; so that when the operate releases the safety pin and presses one of the handles, the safety hammer moves down also pressing said torque spring. When further pressure is applied by the operator on said handle said handle pushes said triggering plate which engages the pin valve thus releasing gas flow through the open orifice.

In order to insure that the operator will not be able to hold said trigger plate in an intermediate position whereby the pin valve may fall into a slanted pit at the end of the triggering plate, thus emitting the gas continuously through the said open orifice, a leaf spring is attached to the said handle, so that when the said safety hammer moves down it is stopped against the said leaf spring and this function can only be overcome by applying heavy pressure on the said handles. When the operator applies a certain pressure on the handles the leaf spring deforms so that the movement of the handles is not possible at an intermediate position. However the handles move towards each other as far as they are free to move to cause the said pin valve to fall into slanted position to return it to its original position to close the gas valve causing only a predetermined amount of tear gas flow. When the pressure is released by the operator and the said handles return to their original position the safety hammer moves up and engages the two handles and locks same so they cannot move even if pressure is applied to the handles.

PREFERRED EMBODIMENTS

In a preferred embodiments the safety hammer may be released by a knob mounted on the hammer's center pin. The knob moves the hammer down along with the two attached handles. The said knob is operated by the operator as will be clearly understood by one skilled in this art.

In another embodiment the triggering plate position can also be adjusted by a knob mounted on the helical compression spring which is on a selected handle.

In another embodiment said helical compression spring and triggering plate are mounted on the moveable handle.

In another embodiment the mechanism of the gas release valve between the handles is covered by two safety cover plates.

The material of construction of the pressure vessel could preferably be made of metal (steel) or reinforced composite plastic material; the trigger mechanisms could be made of steel, aluminum or rigid reinforced plastic.

For a more complete understanding of the above and other features and advantages of the invention, reference should be made to the following detailed description of a preferred embodiment and to the accompanying drawings.

DESCRIPTION OF THE DRAWINGS

In the drawings, like referenced numerals denote corresponding parts throughout the several views.

DESCRIPTION OF THE INVENTION

Figure 1:
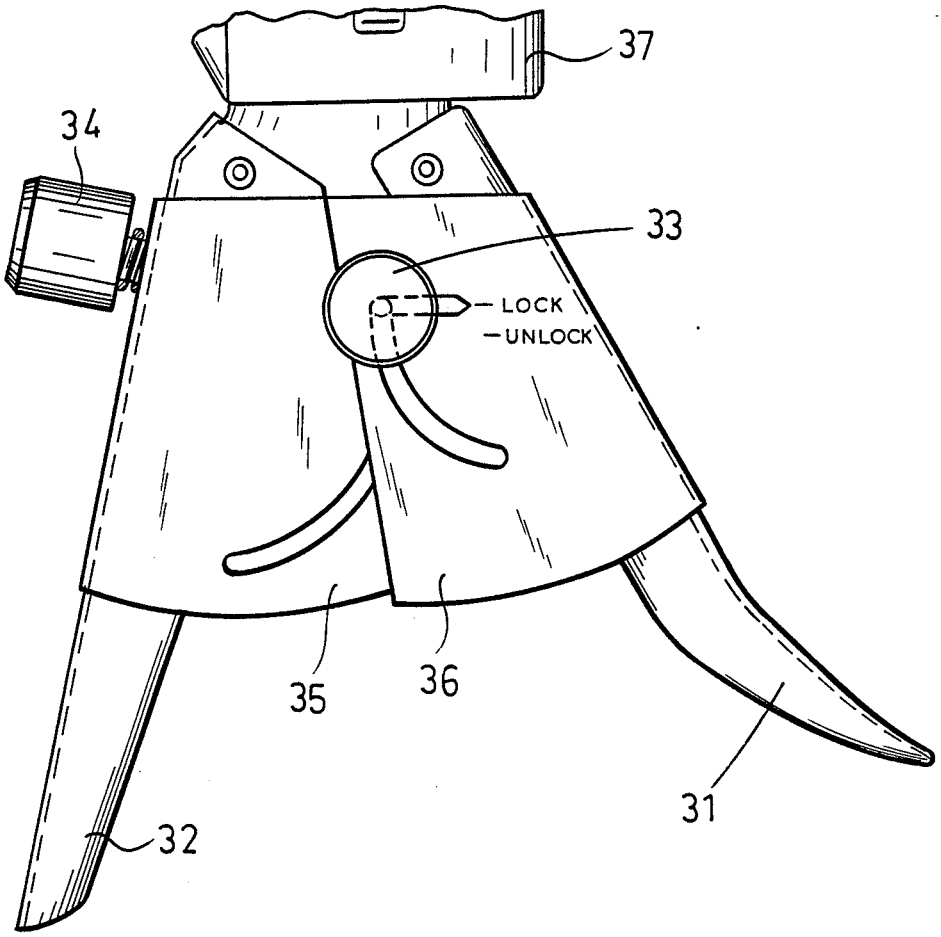
FIG. 1 is an elevational view that shows the safety device contemplated herein.

FIG. 1 illustrates the functioning of the mechanism, as will be understood by one skilled in the art, when the operator presses together the handles 31 and 32. After pressing down on the knob 33 the safety hammer 38 is then pressed enabling handle 32 to move anticlockwise against the handle 31, the hammer 38 then will move down to also press on leaf spring 39. When further pressure is applied on the handles 31 and 32 spring 39 is compressed allowing uninterrupted movement of the triggering plate 40 towards pin valve 42 which operates the gas release valve 37.

Immediately after this procedure, and as best seen by viewing FIGS. 3, 4, 5 and 6 successively, pin valve 42 slides in an uninterrupted manner to penetrate into the slanted pit or depression at the lower part of the triggering plate 40, thus releasing the pin valve 42 to thereby close the valve 37. When the pressure is released from the handles 31 and 32, the helical spring 44 moves the triggering plate 40 back to its original position. Torque spring 41 moves hammer 38 to its position locking the movement of the handles 31 and 32 by the arm 43.

FIG. 1 shows the function of the safety hammer designated 38, connected to the arm 43. Spring 41 presses hammer up when the pressure is released, and knob 33 presses arms down when operator applies pressure by thumb. Cover plates 35 and 36 shields the mechanism.

Figure 2:
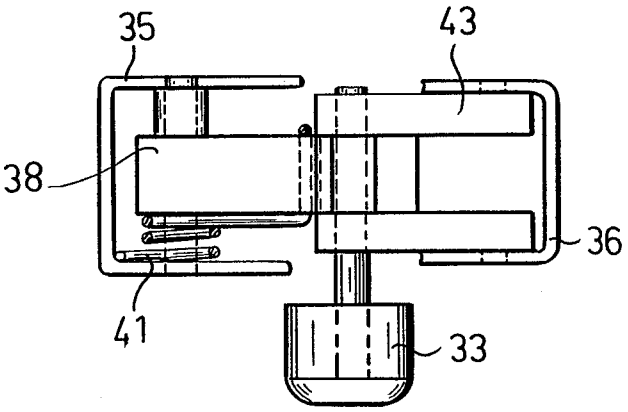
FIG. 2 is a sectional plan view that shows the safety device.

FIG. 2 shows the function of the safety hammer 38, connected to the arms 43. Spring 41 presses the hammer up when pressure is released, and knob 33 presses the arms down when the operator applies pressure. Cover plates 35 and 36 shields the mechanism as indicated hereinabove.

Viewing FIGS. 3, 4, 5, 6 successively illustrates the functioning of the mechanism at different positions, when the operator presses together the handles 31 and 32 after pressing down on knob 33 (not seen). The safety hammer 38 is pressed down, enabling handle 32 to move in this embodiment anticlockwise towards handle 31. The hammer 38 moves down also to press on the spring 39.

Figure 3:
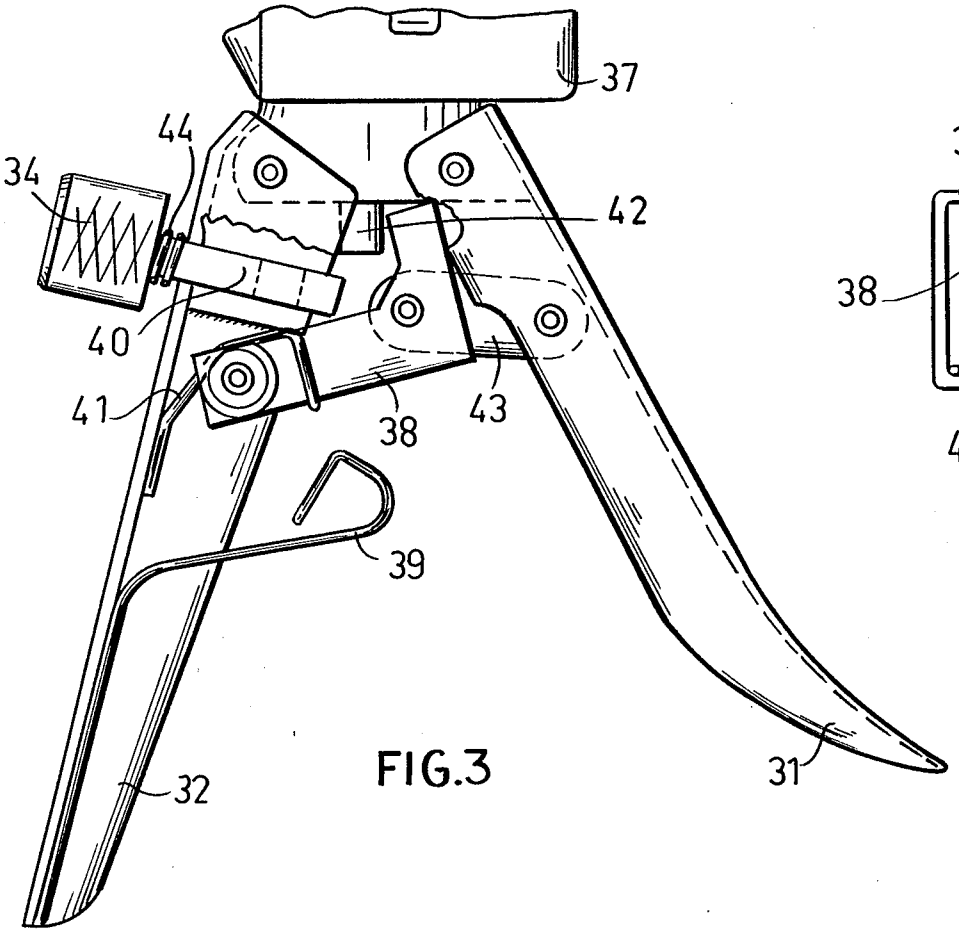
FIGS. 3, 4, 5, 6 are partial cross-sectional views of the device which depict the mechanism in steps of operation.
Figure 4:
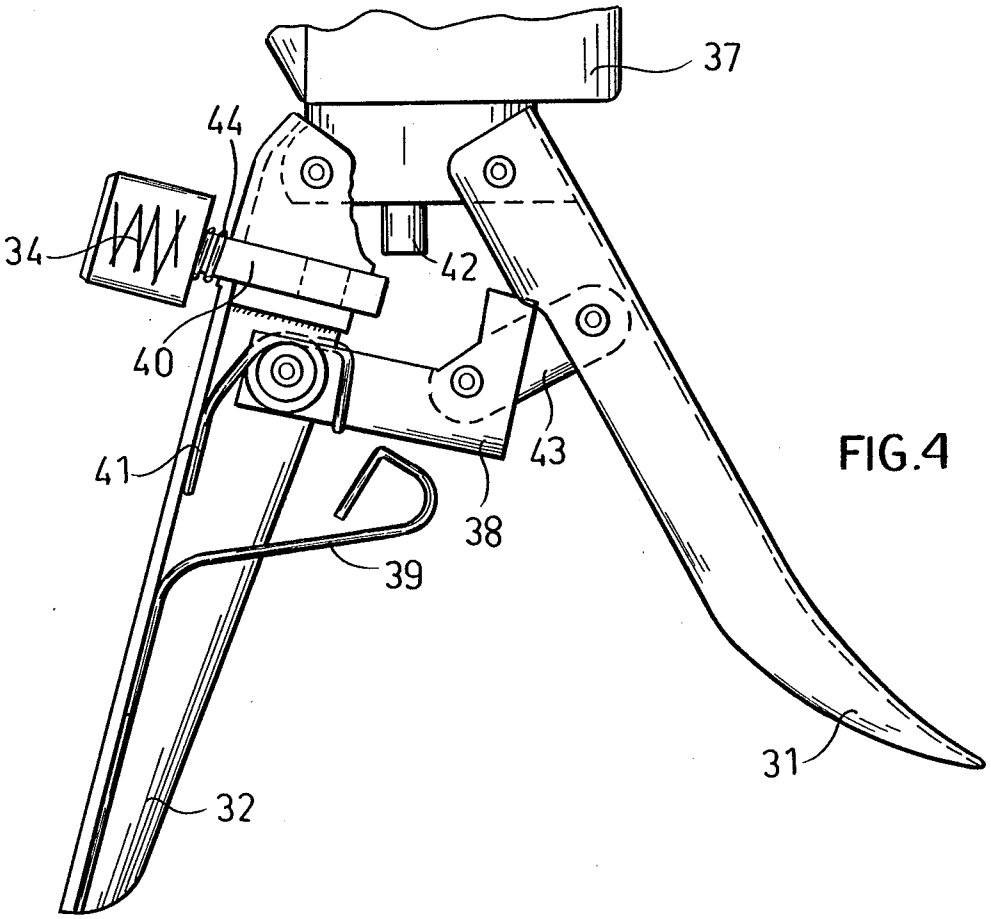
Figure 5:
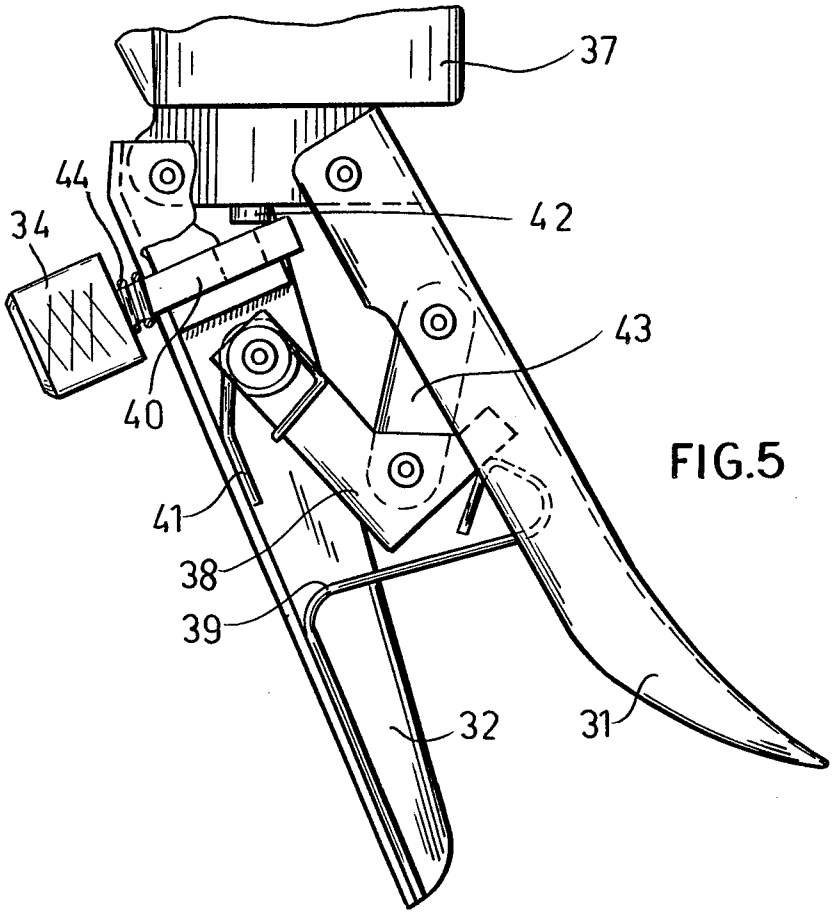
Figure 6:
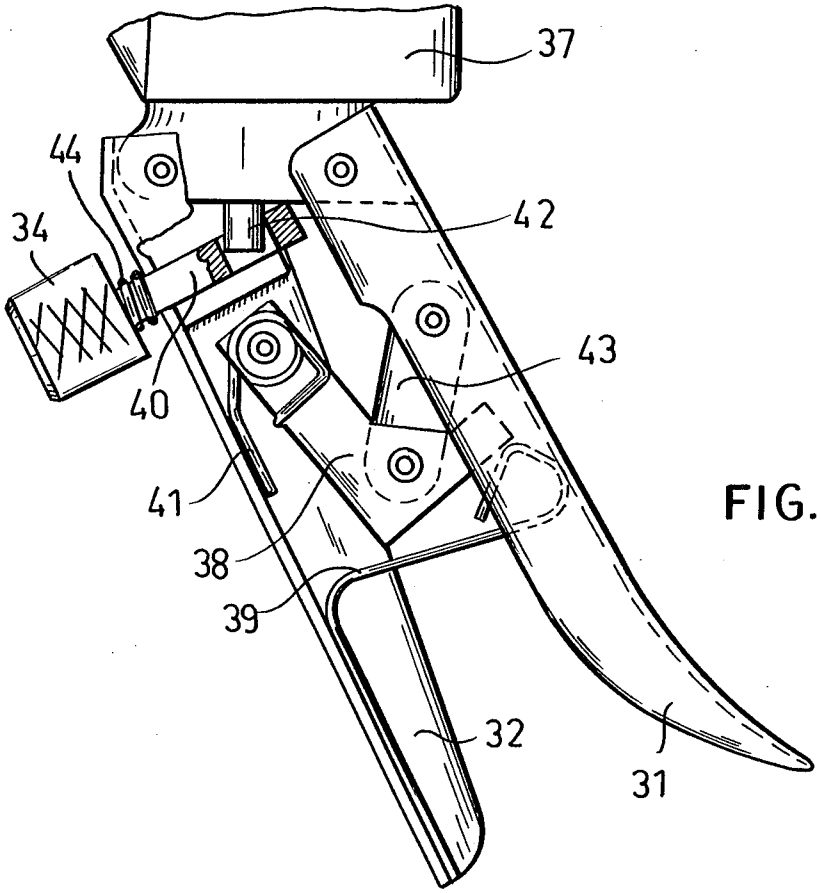

When further pressure is applied on the handles 31 and 32, the spring 39 is compressed allowing uninterrupted movement of the triggering plate 40 towards pin valve 42 which operates the gas release valve 37. Immediately after opening of the valve, pin valve 42 slides in an uninterrupted manner to penetrate into the slanted pit at the lower part of the triggering plate 40 thus releasing pin valve 42 which causes a closing of the valve 37 (as in FIG. 6). When pressure is released from the handles 31 and 32, the helical spring 44 moves triggering plate 40 back to its original position. Spring 41 moves hammer 38 to its position locking the movement of the handles 31 and 32 by the arms 43 (as shown in FIG. 3).

Figure 7:
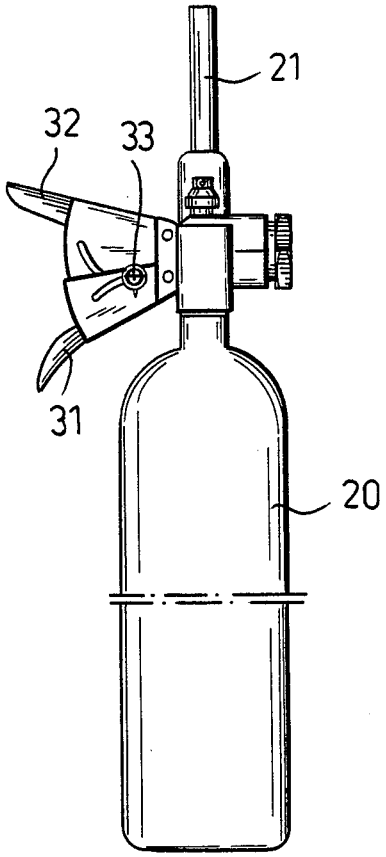
FIG. 7 is a side elevational view of the tear gas device contemplated herein, showing the semi automatic trigger mechanism which is the subject of this invention.

In FIG. 7 there is shown a pressure vessel 20 containing a pressurized solution of the tear gas forming ingredient. The vessel 20 is connected to a device for releasing the spray particles in the vessel through a pipe 21 when trigger 32 is pressed towards the user. Handle 31 is for convenience of the user.

It should be understood, of course, that the specific forms of the invention herein illustrated and described are intended to be representative only as certain changes may be made in the invention without departing from the clear teachings of the disclosure. Accordingly, reference should be made to the following appended claims determining the full scope of the invention.

I claim:

1. A semi automatic device for applying tear gas containing a compressed solution of a tear producing chemical disposed in a suitable solvent, said compressed solution being released from said vessel as desired by the gas in the pressure vessel through a valve disposed on said pressure vessel; said valve having a small orifice, said valve being controlled by a pin valve and said pin valve being operated by a triggering plate mounted coaxially to a helical spring on one of two triggering handles of said device, and the spring mounted on said one handle to operate said triggering plate when pressure is applied on it by the other handle, and a safety hammer mounted between the two handles which when pressed down by said one handle against the other handle causes said safety hammer to be released and said safety hammer to move down to press said spring and causes said spring to push said triggering plate to engage said gas pin valve thus releasing gas flow; said gas pin valve adapted to penetrate into a slanted pit at the end of the said triggering plate thus returning it to the original position by the action of a spring closing the said gas valve which results in a predetermined amount of tear gas flow and when the pressure is released and the said safety hammer moves up engaging the said two handles to lock same.

2. The semi automatic device according to claim 1 further comprising a torque spring mounted on said same handle operating said triggering plate such that when pressure is applied on said triggering plate by the other handle of said device said safety hammer is thereby moved from its locked position to being pressed down against said torque spring so that when the operator releases said safety hammer by pressing said one handle towards said helical spring said safety hammer moves down also pressing said torque spring and when further pressure is applied by the operator on said one handle the said handle pushes said triggering plate to engage said gas pin valve thus releasing gas flow through an open orifice, said pin valve penetrating into a slanted pit at the end of such triggering plate thus emitting the predetermined amount of tear gas continuously through said open orifice; and a leaf spring attached to said one handle so that when safety hammer moves down it is stopped against said leaf spring and can only be overcome by applying strong pressure on said one handle, and if excessive pressure is applied on said leaf spring it deforms so that the movement of said handles cannot stop at any intermediate position but said handles move towards each other as far as they are free to move causing said pin valve to penetrate into said slanted pit returning it to its original position to cause closing of said gas valve so that only a predetermined amount of tear gas flows, and when the pressure is released by the operator and the said handles return to their original position said safety hammer moves up and engages said two handles and causes said handles to lock.

3. A semi automatic device according to claim 2 wherein said triggering plate position can be adjusted by a knob mounted on said helical spring placed on said one handle.

4. A semi automatic device according to claim 3 wherein the triggering mechanism is covered by two safety cover plates.

5. A semi automatic device according to claim 2 wherein said safety hammer is attached to two arms by a center pin and is released by a first knob mounted to the center pin and the hammer being moveable downwardly with the attached two arms, said knob being operable by an operator.

6. The semi automatic device according to claim 1 wherein said safety hammer is attached to two arm s by a center pin and is released by a first knob mounted to the center pin thereby moving said hammer down with said attached two arms.

7. The semi automatic device according to claim 6 wherein the said triggering plate position can be adjusted by a second knob mounted to said helical spring mounted on said one handle.

8. The semi automatic device according to claim 1 wherein the pressure vessel is made of metal or reinforced composite plastic material.

* * * * *